US006831654B2

(12) United States Patent
Pether et al.

(10) Patent No.: US 6,831,654 B2
(45) Date of Patent: Dec. 14, 2004

(54) DATA PROCESSING SYSTEM

(75) Inventors: David Neil Pether, Wokingham (GB); Stephen John Gibbon, Santa Clara, CA (US)

(73) Assignee: LSI Logic Corporation, Milpitas, CA (US)

( * ) Notice: Subject to any disclaimer, the term of this patent is extended or adjusted under 35 U.S.C. 154(b) by 205 days.

(21) Appl. No.: 09/916,974

(22) Filed: Jul. 27, 2001

(65) Prior Publication Data

US 2002/0111975 A1 Aug. 15, 2002

(51) Int. Cl.[7] ..... G09G 5/37

(52) U.S. Cl. ..... 345/562; 345/531; 345/539; 345/559; 345/567; 718/108

(58) Field of Search ..... 345/501–506, 345/519–520, 522, 530–574; 707/100, 104.1; 718/100, 104, 108, 107

(56) References Cited

U.S. PATENT DOCUMENTS 4,837,447 A * 6/1989 Pierce et al. ..... 250/492.2
4,845,656 A * 7/1989 Nishibe et al. ..... 345/562
6,020,901 A * 2/2000 Lavelle et al. ..... 345/509

* cited by examiner

*Primary Examiner*—Kee M. Tung
(74) *Attorney, Agent, or Firm*—Christopher P. Maiorana, P.C.

(57) ABSTRACT

A data processing system comprising a block move engine, a memory, a register and a reader. The block move engine may be configured to process data. The memory may be configured to store data in the form of a linked list comprising a plurality of items of control data. The register may be associated with the block move engine and configured to control the block move engine, in response to the control data. The reader may be configured to read the control data from the memory and apply the control data to the register.

19 Claims, 9 Drawing Sheets

DATA PROCESSING SYSTEM

This application claims the benefit of United Kingdom Application No. 0103472.7 filed Feb. 13, 2001.

FIELD OF THE INVENTION

The present invention relates to control of data transfer in a data processing system generally and, more particularly, to a method and apparatus for transferring or copying blocks of data between memory locations in a data processing system. The invention may be particularly useful in the transfer (or copying) of blocks of graphics data utilizing a block move engine (BME).

BACKGROUND OF THE INVENTION

The use of block move engines (also known as "bit blitters" or "blitting engines") for rapidly copying blocks of graphics data between memory locations in data processing systems is a well established technique for graphics processing. Operation of a BME can involve the setting up of many BME control registers by a central processing unit (CPU) to define the task which the BME is intended to perform. Such tasks can be repetitive or involve steps which alternately take a long or short time to run. However, the CPU must wait for each task to finish before setting the registers for the next task.

Referring to FIG. 1, a data processing system 100 incorporating a BME for graphics processing is shown. The data processing system 100 includes a CPU 102 and a memory 104, each connected to a system bus 106. A BME 108 is also connected to the system bus 106 for reading and writing data to and from the memory 104. A plurality of control registers 110 are configured to control the BME 108 and determine the processing task or tasks that the BME 108 is to perform.

The control registers 110 are connected to the CPU 102 via a data link 112. The CPU 102 transmits data to the control registers 110 which defines an operation of the BME 108. Once correctly set up by the CPU 102, the control registers 110 effectively contain a set of instructions for controlling the operation of the BME 108. The BME 108 is then able to access blocks of graphics data stored in the system memory 104. The BME 108 can combine blocks of data and write the blocks back to the memory 104 (or copy them from one location in memory to another). A series of instruction sets written in the control registers 110 have a number of steps that (i) are repetitive or (ii) alternatively require varying degrees of time for the BME 108 to perform. Once all of the steps in the set of instructions have been performed by the BME 108, a signal TASKEND is sent by the BME 108 to the CPU 102. The CPU 102 then clears the control registers 110 and transmits a further set of control data to the register 110.

It is a disadvantage of the system 100 that the CPU 102 is required to update the control registers 110 with new control data for the BME 108 at frequent intervals. In addition, since the tasks carried out by the BME 108 do not take equal amounts of time to perform, the CPU 102 is often required to wait for each task to finish before setting the registers for the next task.

SUMMARY OF THE INVENTION

The present invention concerns a data processing system comprising a block move engine, a memory, a register and a reader. The block move engine may be configured to process data. The memory may be configured to store data in the form of a linked list comprising a plurality of items of control data. The register may be associated with the block move engine and configured to control the block move engine, in response to the control data. The reader may be configured to read the control data from the memory and apply the control data to the register.

The objects, features and advantages of the present invention include providing a BME that may (i) operate substantially independently of the CPU, (ii) allow the CPU to carry out other functions and/or (iii) improve processor efficiency and performance.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 2:
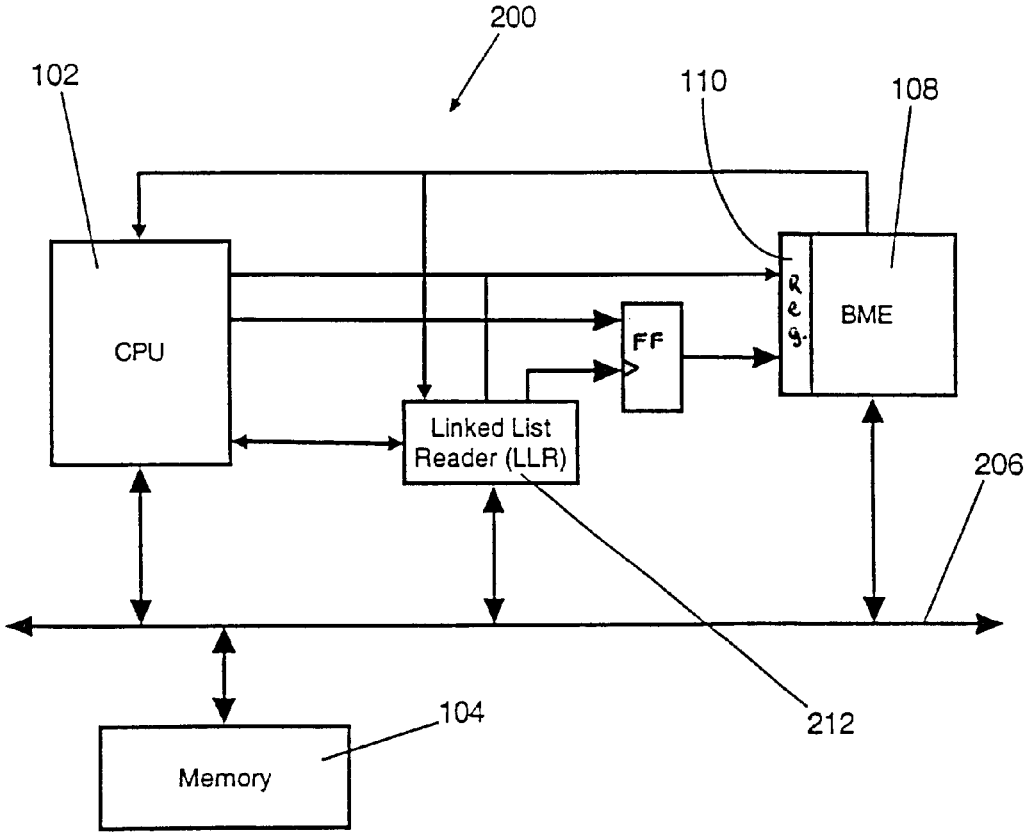
FIG. 2 is a block diagram of a preferred form of data processing system according to the invention.

Referring to FIG. 2, a block diagram of a data processing system 200 is shown in accordance with a preferred embodiment of the present invention. The data processing system 200 generally comprises a CPU 102, a memory 104 and a BME 108. The BME 108 may have a plurality of associated control registers 110. The CPU 102, the memory 104 and the BME 108 may each be connected to a system bus 206. The data processing system 200 may also comprise a linked list reader (LLR) 212 that may be connected to the bus 206. The linked list reader 212 may be arranged to access the system memory 104 via the bus 206 to read the memory control data for the BME 108 in the form of a linked list. Linked lists may be used for communication between system processors and passing sequences of instructions between CPUs. The linked list may be useful where a given sequence of operations is run many times with little or no alteration (e.g., in graphics animations).

Figure 3A:
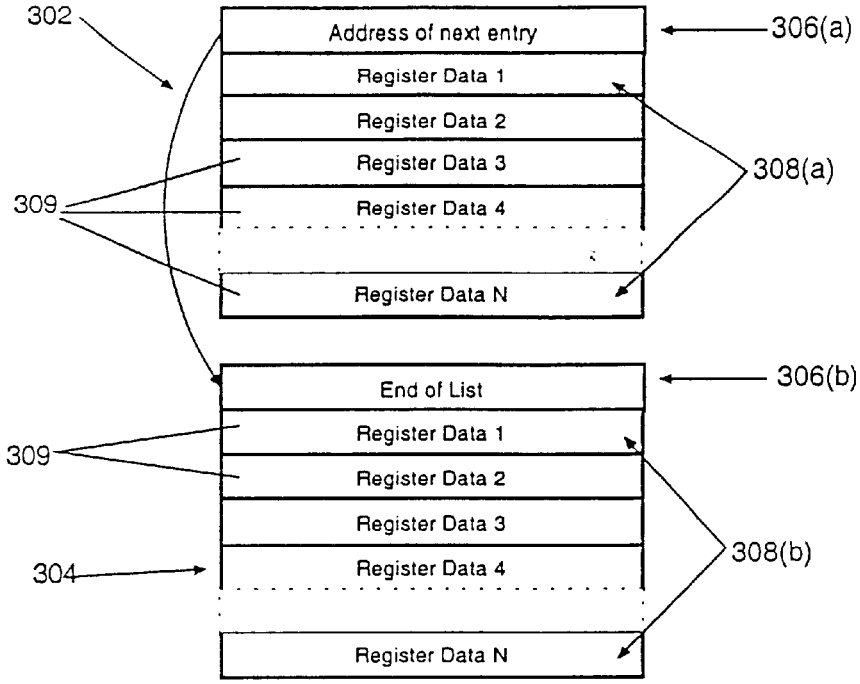
FIG. 3*a* shows the format of a linked list as used in the system of FIG. 2.

Referring to FIG. 3, a linked list comprising a number of entries (or items) 302 and 304 each having a header portion 306*a* and 306*b* and a payload portion 308*a* and 308*b* is shown. The header portion 306*a* and 306*b* of each item 302 and 304 may contain the address of the next item in the list.

Thus, the items of a linked list may not be stored sequentially in the system memory 104. The header portion 306*b* of the last item in the list may have a null link. The null link may have a value of 0 to indicate that there are no more items in the list. The payload portion 308*a* and 308*b* of each item 302 and 304 may comprise a number of addresses 309 that may contain all of the control data for the BME registers 110. The control data may be stored in a fixed order and may enable the BME 108 to perform a single task. For example, a task may be reading of two or more blocks of data from the memory 104, combining the blocks into a single block, and writing the combined block back to the memory 104.

The data processing system 200 may also allow the BME 108 to perform a sequence of tasks. A sequence of tasks that the BME 108 is to perform may be constructed as a linked list in the memory 104. The CPU 102 may construct the sequence of tasks as a linked list in the memory 104, where each task may be represented by a separate item in the list. Each item may not be required to be stored sequentially in the memory 104, since each subsequent item in the list may be identified in the header portion of the previous item. Once the linked list is completed by the CPU 102 and all of the required control data for each item payload is present in the memory 104, the CPU 102 may provide the LLR 212 with the address in the memory 104 of the first item in the list data.

The LLR 212 may then access the memory 104 via the system bus 106 and read the first item in the linked list from the memory 104. The header 306*a* of the first item may point to an address in the memory 104 of the second item on the list. The header 306*a* may be stored internally by the LLR 212, while the payload control data from the addresses 309 may be applied to the control registers 110 via the data link. Once all of the payload data has been transferred from the LLR 212 to the control registers 110, the LLR 212 may send a signal (e.g., TASKSTART) to the BME 108 that may instruct the BME 108 to begin performing the task. When the task is completed, the BME 108 may send a signal (e.g., TASKEND) to the LLR 212 indicating that the BME 108 may be ready to receive the control data for the next task.

The LLR 212 may then access the memory 104 via the system bus 106 and read the data for the second item in the list from the memory 104 using the header portion 306*a* of the first item to point to the correct address in the memory 104. The header portion 306*b* of the second item may be again stored internally by the LLR 212, while the payload control data may be transferred to the control registers 110. The process may be repeated for all items in the list. Once the last item in the list read by the LLR 212 has been completed by the BME 108, the BME 108 may send the signal TASKEND to the LLR 212 which then may return control of the registers 110 and the BME 108 to the CPU 102.

Often, some of the control data for the BME 108 may remain the same for different tasks. It would be advantageous if only the new data for the next task were to be loaded into the control registers 110. This may be achieved by the data processing system 200 by enabling the LLR 212 to load the control registers 110 selectively.

Figure 3B:
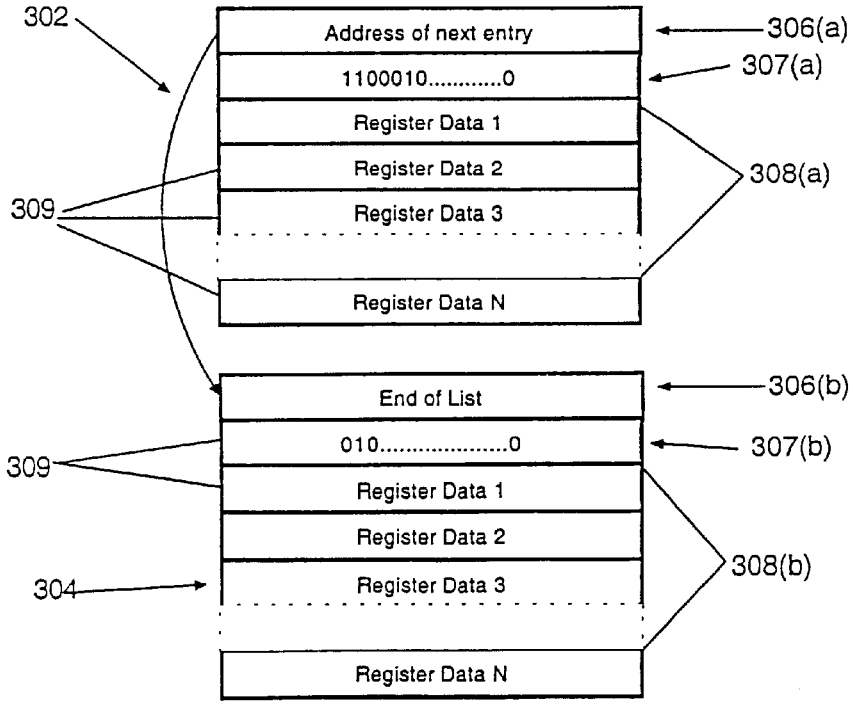
FIG. 3*b* shows the format of a modified linked list as used in the system of FIG. 2.

Referring to FIG. 3*b*, a modified form of the linked list in which each item in the linked list may have an additional header portion 307*a* and 307*b* containing a plurality of bits is shown. Each bit may correspond to one register in the control registers 110 and the status of each bit (e.g., 0 or 1) may indicate which of the registers 110 are to be loaded with new data. As a result, the control data held in the control registers 110 may remain constant until, if, and when the control data may be updated. This modification may be achieved in one of two ways:

(i) the payload for each item in the linked list may be of full length (e.g., containing data for all BME registers 110) with the second header portion identifying which of the registers 110 are to be updated from the addresses 309 with new data. The LLR 212 may then read only the required payload data from memory corresponding to the registers which are to be updated according to the second header portion. An advantage of this method may be that, although each payload may be relatively long, a given selection of functions may be achieved by adjusting the header portions of a very small number of lists. For example, the register data 1 and 2 of the payload may be written to the corresponding control registers 110 of the BME 108 while the register data 3 may not.

(ii) each payload in the list may be shortened by the CPU 102 to contain data for only individual registers that may be updated. Thus, if only three of the control registers 110 are to be updated with new data for a single task, then the item payload for that task may contain only three data words. The second header portion may still be present, but only the bits representing the three BME registers 110 may be updated (e.g., logic 1 with the remainder bits being logic 0). Thus the payload data from the memory locations of the item of the linked list may be written to the BME registers 110 determined by the second header portion. An advantage of this method may be that each list item may be relatively short. However, the list may contain more items and a greater number of lists may be required to perform a given selection of functions.

Both of the methods (i) and (ii) may have the advantage that there may be no necessity to reload all of the control registers 110 for each task to be carried out by the BME 108, which saves time and memory use. In addition, the methods (i) and (ii) may be particularly useful where there are, for example, large color look up tables (CLUTs) which are constant for a whole sequence of tasks. The methods (i) and (ii) may also be set up once by the first item on the list and not changed subsequently. The LLR 212 and method of operation thereof may be employed in addition to, or as an alternative to, the typical method of the CPU 102 for controlling and updating the control registers 110 in order to operate the BME 108.

Further performance advantages for the BME 108 may be achieved by utilizing a (i) double buffering or (ii) dual context (e.g., context switching) method. Double buffering generally involves the use of two sets of registers connected sequentially (e.g., in series) between the CPU 102 and the BME 108. The BME 108 may read from the second control register, while the CPU 102 inputs data to the first control register. When the BME 108 is done utilizing the control data in the second register, the first control register may transfer control data to the second control register and the CPU 102 may then input the next set of control data to the first control register. Double buffering may allow the CPU 102 to set up the first control register for the next task, while the BME 108 is running a current task, using the second control register. Dual context (context switching) may use two (or more) of the control registers 110 connected in parallel between the CPU 102 and the BME 108. The CPU 102 may switch input control data to either of the control registers 110. The BME 108 may then read the data from either of the control registers 110. Context switching may be useful when many of the tasks to be performed by the BME 108 are similar, such that the data stored in either or both of the registers 110 may remain the same. Thus, the control data for one task may be constant in one of the control registers 110 and the other one of the control registers 110 may be used for all other tasks. Double buffering and context switching may be typical applications.

Figure 1:
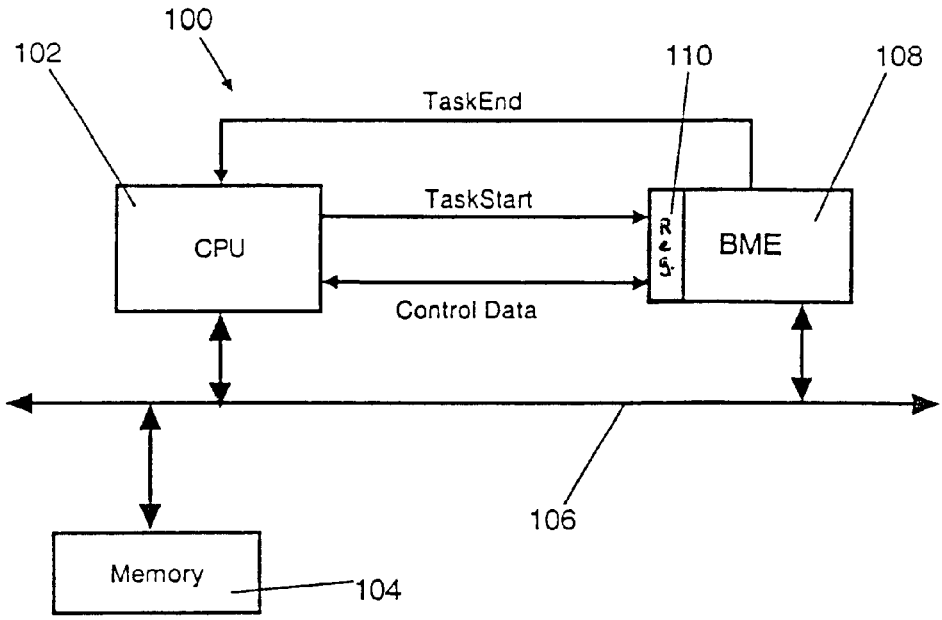
FIG. 1 is a block diagram of a typical data processing system incorporating a BME.

It will be appreciated that it may be possible to perform double buffering and/or context switching in the circuit 100 of FIG. 1 by the use of a triple or quadruple set of control registers 110 configured in the appropriate manner. However, the BME 108 of FIG. 1 would require control registers totalling hundreds of bits and include considerable circuit overhead to provide such a large number of registers. Since double buffering and dual context configurations are not normally required simultaneously, it may be typical to provide circuitry to perform one or the other mode of operation, but not both. However, the modified system 200 of FIG. 2 may allow a single two-register configuration to provide both double buffering and/or context switching. The modified system 200 of FIG. 2 may provide a compromise saving in circuitry without significant loss in circuit performance.

Figure 4A:
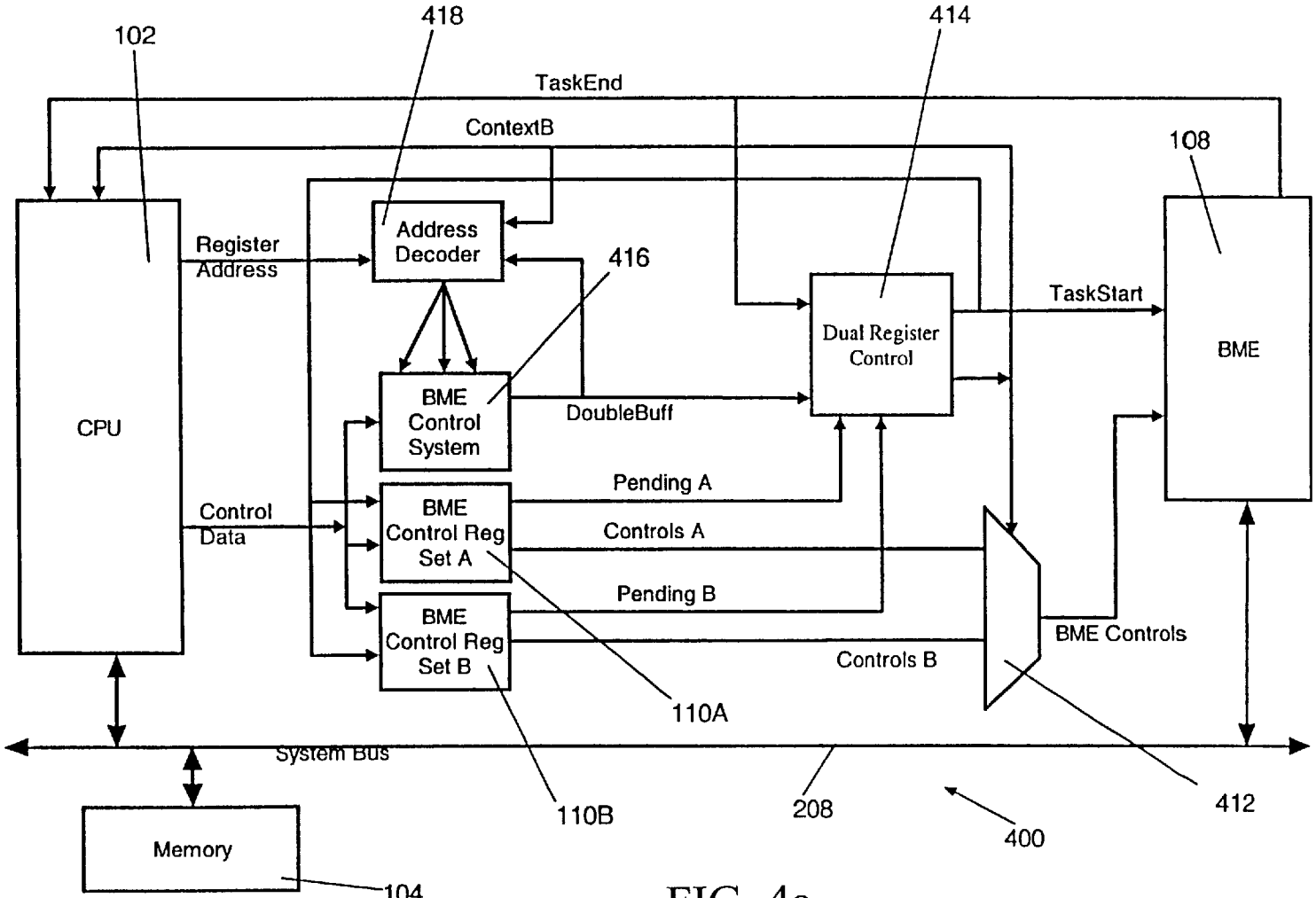
FIG. 4*a* is a block diagram of a modification to the system of FIG. 2.

Referring to FIG. 4*a*, a further form of a circuit 400 according to the present invention is shown. In addition to the CPU 102, the memory 104, the system bus 106 and the BME 108, the data processing system 400 may have two control register sets 110*a* and 110*b* the outputs of which are applied to the BME 108 via a multiplexer 412. The multiplexer 412 may be operable to selectively connect the output of register set 110*a* (or 110*b*) to the BME 108 in dependence on a signal (e.g., CONTEXTB). The signal CONTEXTB may be generated by a register control unit 414. If the signal CONTEXTB is 0, then the output of register set 110*a* may be connected to the BME 108 by the multiplexer 412. If the signal CONTEXTB is 1, the output of register set 110*b* may be connected to the BME 108 by the multiplexer 412. The data processing system 400 may also include a BME control unit 416 that may be arranged to generate a signal (e.g., DOUBLEBUFF). The signal DOUBLEBUFF may indicate if the system 400 may operate in a double buffered mode or in a context switching mode. The signal DOUBLEBUFF may be applied to the register control unit 414 and to an address decoder 418.

The register sets 110*a* and 110*b* may each generate a signal (e.g., PENDINGA and PENDINGB), respectively. The signals PENDINGA and PENDINGB may be applied to the register control unit 414. The signals PENDINGA and PENDINGB may indicate that the relevant control register set 110*a* or 110*b* may be ready. Additionally, the signals PENDINGA and PENDINGB may be generated when the setup of the respective register set 110*a* or 110*b* by the CPU 412 has been completed and the data held in the register set 110*a* or 110*b* may be ready to be applied to the BME 108.

The address decoder 418 may contain two memory maps for the control register sets 110*a* and 110*b*, one for the context switching mode and one for the double buffered mode. In the context switching mode, the register set 110*a* may be memory mapped to memory addresses (e.g., N001 to N030) in the memory 104, while the register set 110*b* may be memory mapped to memory addresses (e.g., N031–N060). The signal DOUBLEBUFF may also be memory mapped to a memory address (e.g., N000) in the memory 104. The address decoder 418 may then be able to observe the memory address of any control data output by the CPU 102 and set the write enable of the register set 110*a* or that of the register set 110*b*. The address decoder 418 may set the write enable in dependence on the address, to enable the control data to be written to the relevant control register set 110*a* or 110*b*. The register set 110*a* or 110*b* to which the control data for a particular task may be written, may be determined by the address decoder 418 in response to a register memory address (e.g., REGISTER ADDRESS) generated by the CPU 102. The address decoder 418 may be configured to observes the address to which the CPU 102 may be writing to within the memory 104. If the address corresponds to either of the register sets 110*a* and 110*b*, the address decoder 418 may set the write enable signal for that register set 110*a* or 110*b* to enable the control data to be written thereto.

Operation of the data processing system of FIG. 4*a* will now be described in both a context switching mode and a double buffered mode.

Context Switching Mode

Context switching mode may be used where a particular task may be performed a number of times (e.g., repetitively) or where the control data for that task does not change significantly. The data for that task may be therefore written to one of the register sets 110*a* or 110*b* and held until the data is no longer required. Control data for all other tasks may be written to the other register set 110*a* or 110*b*. Thus, the control data for a number of successive tasks (where none or only a small part of the control data changes) stored in one of the register sets (e.g. 110*a*), may be read by the BME 108 in successive read operations. When there is a substantial change in the control data, the change may be written to the other register set (e.g., 110*b*) and read by the BME 108 on a next read operation. Both register sets 110*a* and 110*b* may be written to by the CPU 102 and therefore the CPU 102 may determine which of the register sets 110*a* or 110*b* may be free for new control data to be written.

The signal DOUBLEBUFF may be set to 0 by the BME control unit 416 to indicate that the context switching mode may be active. From the status of the signal DOUBLEBUFF, the register control unit 414 may know a configuration of the register sets 110*a* and 110*b* (e.g., which register set 110*a* or 110*b* is connected to the BME 108 via the multiplexer 412). If, in the first instance, the CPU 102 wishes to write control data representative of a first task to the register set 110*a*, the memory address of the register 110*a* may be sent by the CPU 102 to the address decoder 418 which may then set the write enable signal of the register set 110*a*. The control data for the first task may then be written by the CPU 102 to the register set 110*a*. The data may be held until all the data is written. When the register set 110*a* is correctly set up, the signal PENDINGA may be generated and sent to the register control unit 414. The register control unit 414 may then set the signal CONTEXTB to 0 to instruct the multiplexer 412 to connect the output of register set 110*a* to the BME 108. The register control 414 may also generate a signal (e.g., TASKSTART) which may be applied to the BME 108 to begin carrying out the first task. Upon generation of the signal TASKSTART, the register control unit 414 may cancel the signal PENDINGA.

The signal CONTEXTB may be generated by the register control unit 414 and sent to the CPU 102. The signal CONTEXTB may indicate to the CPU 102 that the register set 110*a* may be active (e.g., control data held in register set 110*a* may be currently used by the BME 108 to perform a task). If control data for a second task is required to be written to the register set 110*b*, the CPU 102 may send the memory address of register set 110*b* to the address decoder 418. The address decoder 418 may then set the write enable signal of the register set 110*b*. The CPU 102 may then write the control data for the second task to the register set 110*b*. When the register set 110*b* is correctly set up, the signal PENDINGB may be generated and sent to the register control unit 414. If the BME 108 has not completed the first task, the control data for the second task may be held in the register set 110*b* which may be maintained in a pending state until the BME 108 issues a signal (e.g., TASKEND) indicating that the processing of the first task may be completed. When the signal TASKEND generated by the BME 108 is received by the register control unit 414, the register control 414 may set the signal CONTEXTB to 1 to instruct the multiplexer 412 to connect the register set 110*b* to the BME 108. The signal TASKSTART may then be set by the register control 414. The BME 108 may then begin to carry out the processing of the second task and the register control unit 414 may cancel the signal PENDINGB. The signal TASKEND may be applied to the CPU 102 and generated by the BME 108 to indicate that the first task has been completed. In addition, the signal CONTEXTB may be applied to the CPU 102 to indicate that the processing of the second task has begun.

In the context switching mode, it may be likely that the third task to be performed by the BME 108 may require the use of the same control data for that of the first task. Since the data may be held in the register set 110*a*, the CPU 102 may instruct the register set 110*a*, via the address decoder 418 and the BME control unit 416, to set the signal PENDINGA. The signal PENDINGA may inform the register control unit 414 that the control data for the next task may be held in the register set 110*a*. On completion of the second task, the BME 108 may issue the signal TASKEND, which may be received by the register control unit 414 and the CPU 102. The register control unit 414 may then reset the signal CONTEXTB to 0, connecting the output of register set 110*a* to the BME 108 via the multiplexer 412. In addition, the register control unit 414 may generate the signal TASKSTART that may instruct the BME 108 to be in processing the third task and to cancel the signal PENDINGA. Upon receipt of the signal TASKEND and the signal CONTEXTB, the CPU 102 may be aware that the control data for the second task from the register 110*b* may no longer be required and, by applying the memory address of the register set 110*b* to the address decoder 418 to set the write enable for the register set 110*b*, thereby overwriting the control data for the second task with the data of a fourth task. The procedure may continue until the control data held in the register set 110*a* may be no longer needed, whereupon the old control data may be overwritten when the CPU 102 writes control data for a new task to the register set 110*a*.

It will be appreciated that the context switching mode of the data processing system 400 of FIG. 4*a* may be utilized where the same task may be performed by the BME 108 a number of times with little or no change to the register settings. Thus, one register set may be dedicated to the repeated task while the other register set may be dedicated to all other tasks.

In context switching mode, the CPU 102 may determine which register to update, since the control data for a particular task may be held in one of the register sets and remain constant for much of the operation time. However, there may be occasions when the control data may be required to be replaced by control data for another task. The value of the signal CONTEXTB may indicate to the CPU 102 if a particular register set is active whether it may be possible to write control data for a new task to the register.

Double Buffered Mode

In the double buffered mode the register sets 110*a* and 110*b* are both memory mapped to the same addresses in the memory 104 such that the CPU 102 effectively "sees" only a single register set to which data may be written. For example, in the double buffered mode, both register sets 110*a* and 110*b* are memory mapped to addresses N001 to N030. The address decoder 418 may allow the CPU 102 to write control data when either one of the register sets 110*a* or 110*b* that is not currently "active." The address decoder 418 may then set the write enable for the inactive register set 110*a* or 110*b*, such that the control data may be written to the inactive register set 110*a* or 110*b*. In order for the address decoder 418 to determine which register set 110*a* or 110*b* may be currently active and which may be inactive, the address decoder 418 may receive the signal CONTEXTB generated by the register control unit 414.

The BME 108 may generate the signal TASKEND indicating that a task held in an active register set has been completed. The register control unit 414 may toggle the signal CONTEXTB, switching the active and inactive registers 110*a* and 110*b* via the multiplexer 412. The register control unit 414 may also send the signal TASKSTART to the BME 108 also instructing the BME 108 to being performing the next task. The signal TASKEND generated by the BME 108 may be received by the CPU 102. The signal TASKEND may indicate that the register set 110*a* or 110*b* may now be inactive and data for the next task may be written. Since the CPU 102 sees only one register set 110*a* or 110*b*, the memory address of the "single" register set 110*a* and 110*b* may be sent to the address decoder 418. The address decoder 418 may set the write enable for the inactive register set 110*a* or 110*b* in dependance on the value of the signal CONTEXTB. Thus, the CPU 102 may always be able to write to the inactive register set 110*a* or 110*b* even though the CPU 102 may only see a single register set 110*a* and 110*b*.

The double buffered mode of operation may be useful where control data for successive BME operations may change significantly. In the double buffered mode, the CPU 102 may not be required to determine which register set 110*a* or 110*b* to write to. The double buffered mode may also allow the CPU 102 to enable faster processing. A specific application for the BME 108 may be in the running of moving graphics or animations. Such an implementation may require the BME 108 to update the object or objects being displayed at a specific time in order to ensure that the animation moves smoothly and the graphics objects are not being modified at the same time as they are being displayed, which may lead to objectionable tearing effects on the display.

Figure 4B:
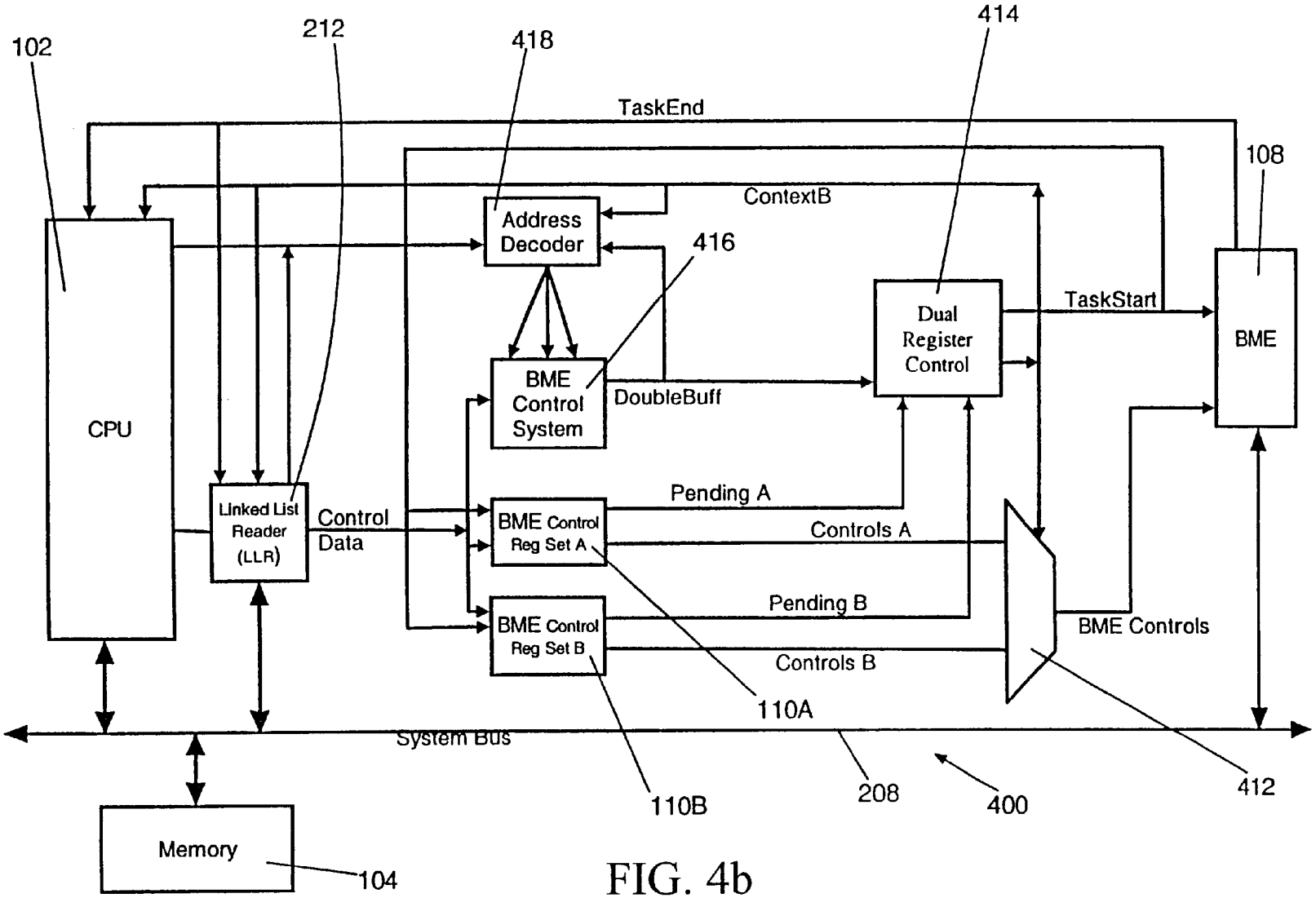
FIG. 4*b* is a block diagram of a modification to the system of FIG. 4*a;*

It will be appreciated by those skilled in the art that it may be entirely possible to use the linked list reader described in the context of FIG. 2 in the data processing system of FIG. 4*a*. Such an embodiment may be shown in FIG. 4*b* where the linked list reader replaces the CPU 102 as the source of the control data for the register sets 110*a* and 110*b*. However, the address decoder 418 may still decide which of the register sets 110*a* or 110*b* the data may be written to in dependence on the signal DOUBLEBUFF and the signal CONTEXTB.

Figure 5A:
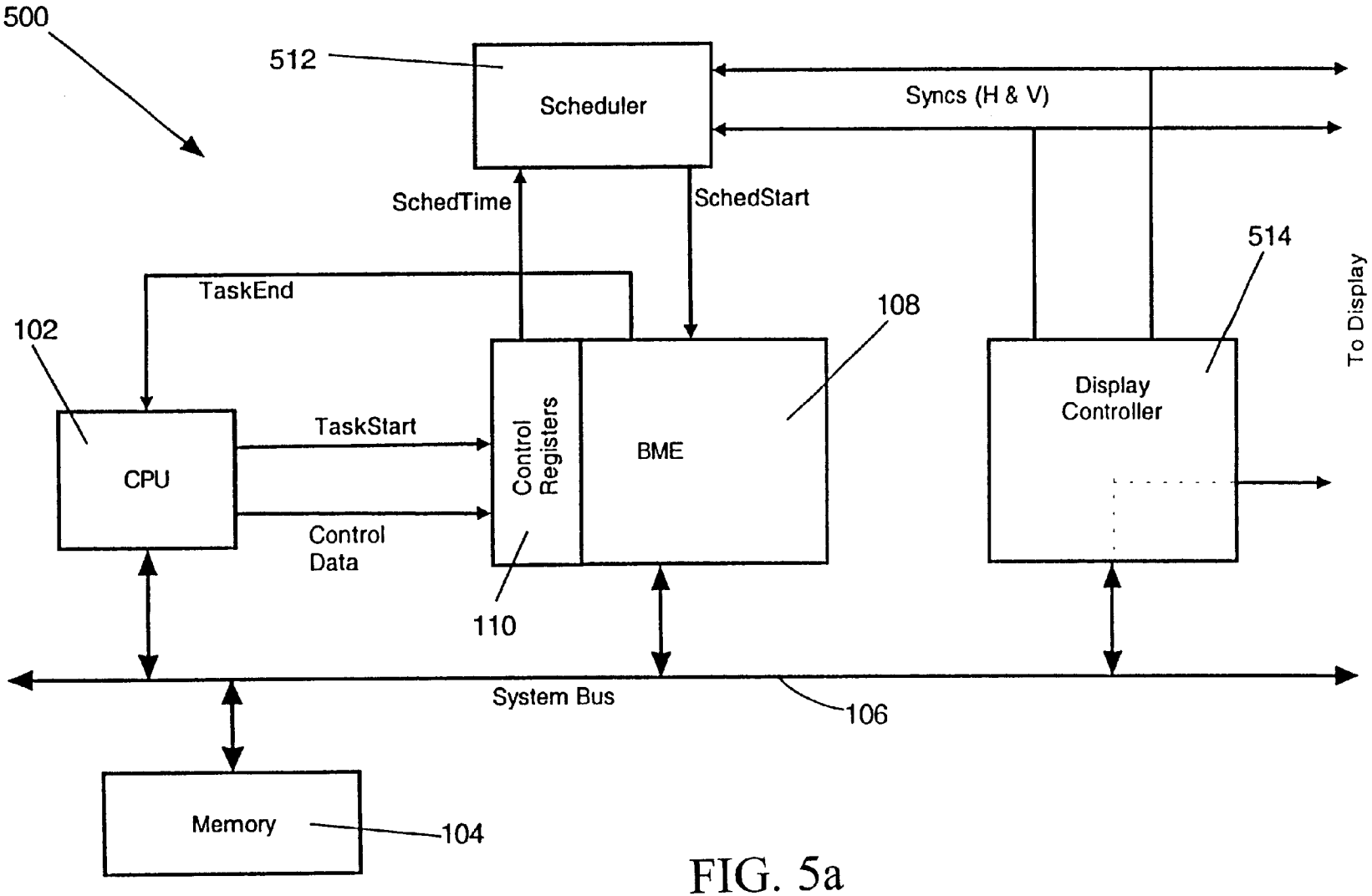
FIG. 5*a* is a block diagram of a further modification to the system of FIG. 2.

Referring to FIG. 5*a*, a modified system 500 of the data processing system 200 of FIG. 2 is shown. The system 500 may allow the tasks performed by the BME 108 to be scheduled in a manner synchronized to the graphics display process. The data processing system 500 comprises a CPU 102, a memory 104, a system bus 106 and a BME 108 with associated control registers 110. The data processing system 500 also comprises a scheduler 512 which may be shown in more detail in FIG. 6. Additionally, the system 500 may comprise a display controller 514 that may be connected to the system bus 106 and arranged to read graphics data from the memory 104, converting the data into a visible object on a display (not shown).

Figure 6:
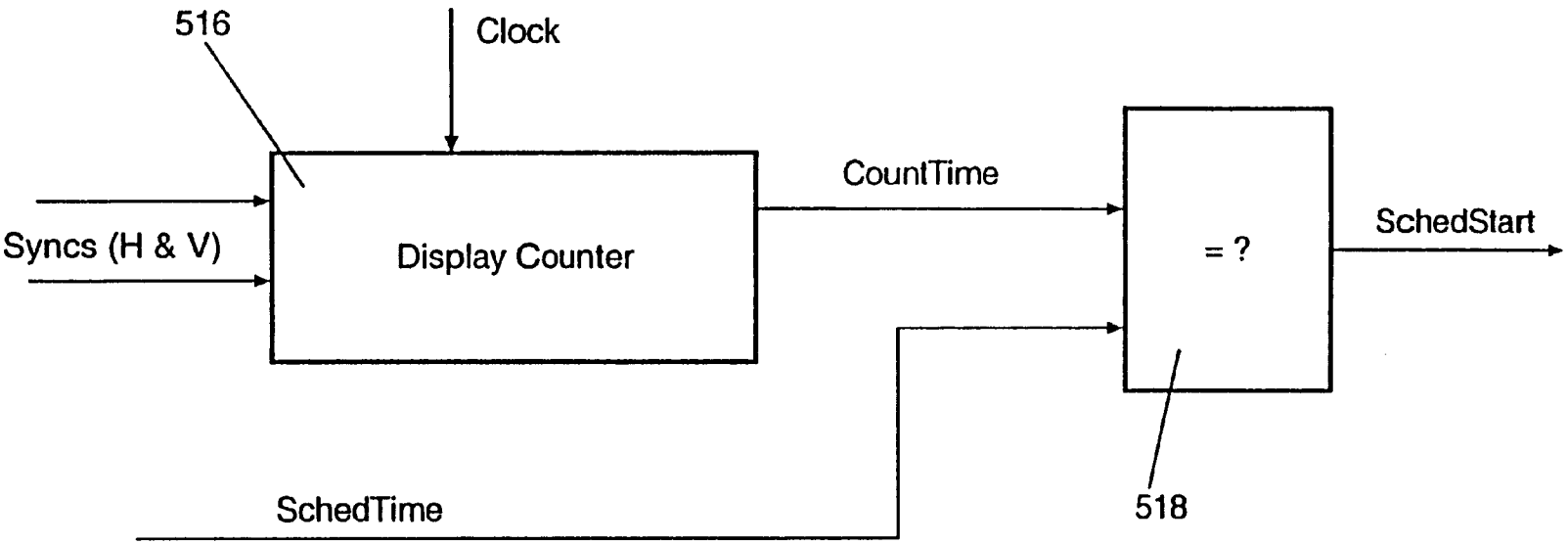
FIG. 6 is a block diagram of part of the system of FIGS 5*a* and 5*b*.

Referring to FIG. 6, the scheduler 512 is shown comprising a display counter 516 that may be configured to receive and lock to synchronizing signals (e.g., H and V SYNCS) generated by the display controller 514. The display controller 514 may generate a signal (e.g., COUNTTIME) that may be incremented in convenient time steps such as display pixels, display line periods or frames. The signal COUNTTIME may reset after every display frame or, alternatively, after a fixed number of frames. The scheduler 512 also includes a comparator 518 configured to receive the signal COUNTTIME. The comparator 518 may compare the signal COUNTTIME with a signal (e.g., SCHEDTIME) generated by the BME 108 control registers 110. The signal SCHEDTIME may be the scheduled time at which the BME 108 may begin performing the task. The signal SCHEDTIME may be a multi-bit number that may be set in one or more of the BME control registers 110. Therefore, the signal SCHEDTIME may represent any possible value which could be valid for the signal COUNTTIME in the scheduler 512. In setting up the control registers 110 to control the BME 108, the CPU 102 may set one or more of the registers 110 to generate the signal SCHEDTIME. The comparator 518 may then compare the signal COUNTTIME and the signal SCHEDTIME and when equal, generate a signal (e.g., SCHEDSTART) that may be applied to the control registers 110 and instructs the BME 108 to begin carrying out the task set by the data in the control registers 110. Thus, by setting the signal SCHEDTIME to a particular value, the BME 108 may be controlled to begin each task at a desired or specific time in the display of a frame or group of frames.

Alternatively, the CPU 102 may be arranged to send, as part of the control data, an additional control signal (e.g., TASKIMMEDIATE) to the control registers 110. The signal TASKIMMEDIATE may be a single ON/OFF control bit. The control registers 110 may then be set up with the control data for the operation which the BME 108 is to perform. Then the signal TASKSTART may be set active by the CPU 102 and the subsequent action of the BME 108 may depend on the setting of the signal TASKIMMEDIATE. If the signal TASKIMMEDIATE is OFF (e.g., set to 0) then the BME 108 may wait until the signal SCHEDSTART becomes active before beginning the task. However, such an case may only occur at a predetermined time in the display process as determined by the signal SCHEDTIME. If the signal TASKIMMEDIATE is ON (e.g., set to 1), the BME 108 may begin to carry out the task as soon as signal TASKSTART is received from the CPU 102. Upon completion of the task, the BME 108 may set the signal TASKEND active to cause the CPU 102 to set up the control data for the next task.

Figure 5B:
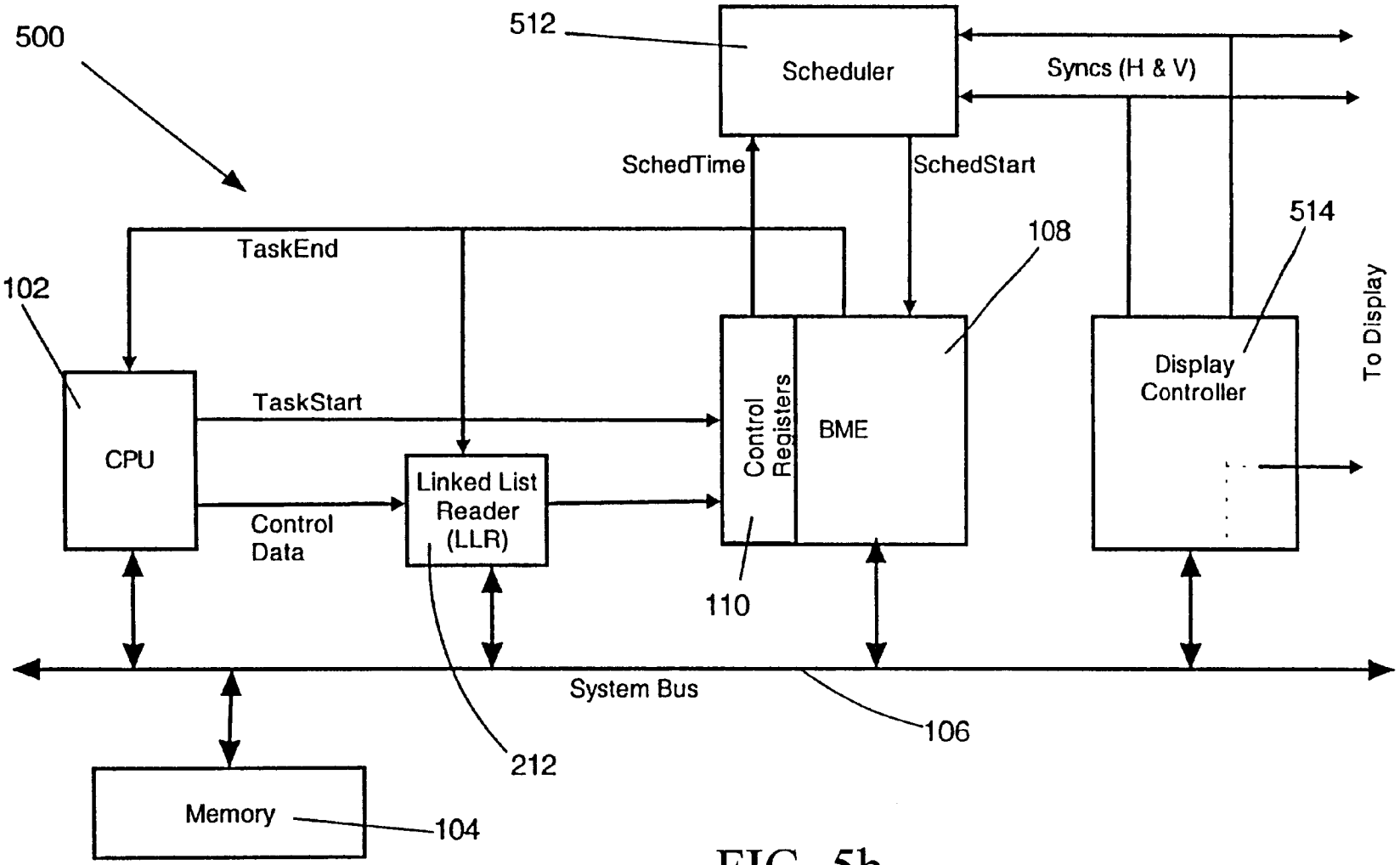
FIG. 5*b* is a block diagram of a modification to the system of FIG. 5*a;*
Figure 5C:
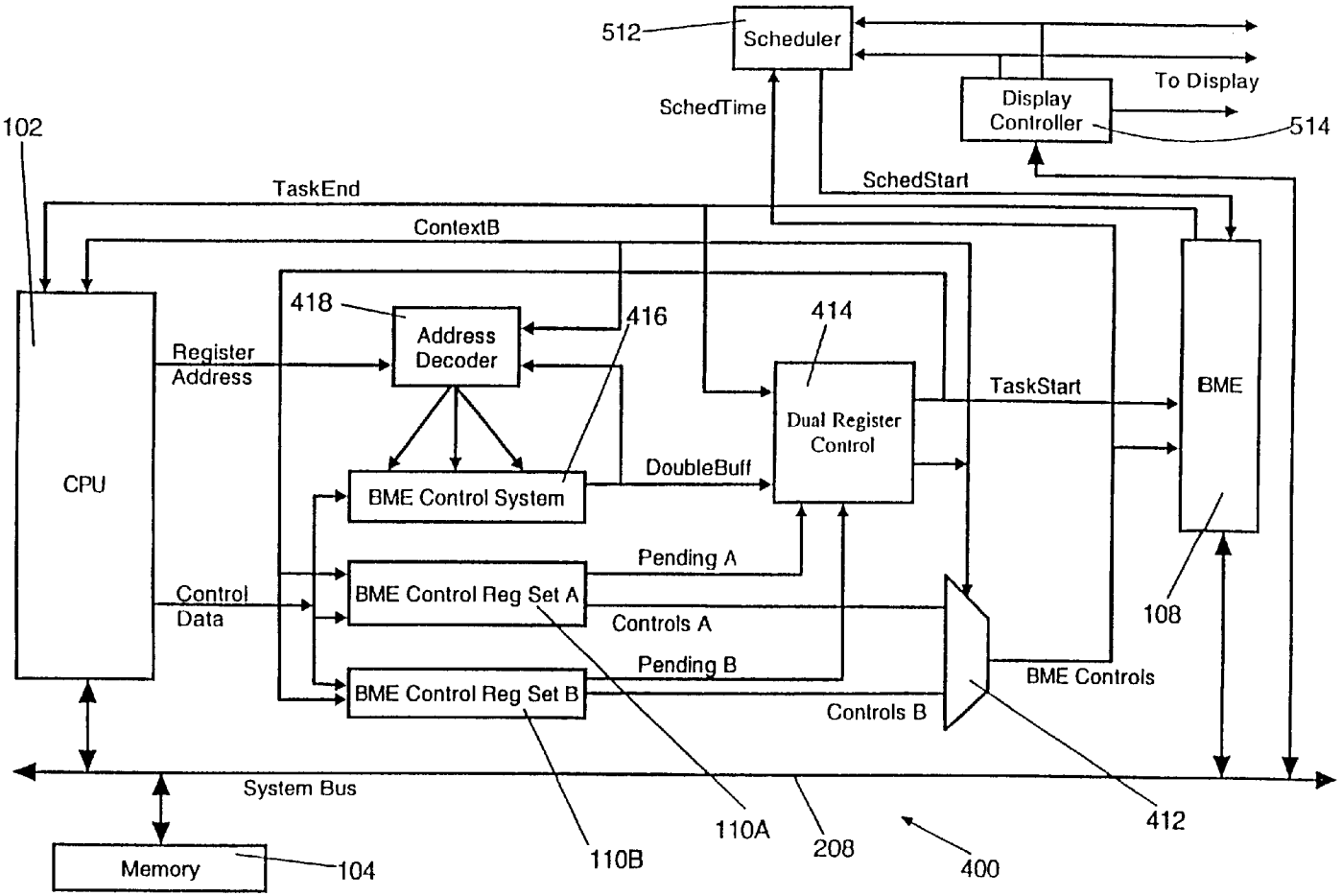
FIG. 5*c* is a block diagram of a modification to the system of FIG. 4*a* using the system of FIG. 5*a;*
Figure 5D:
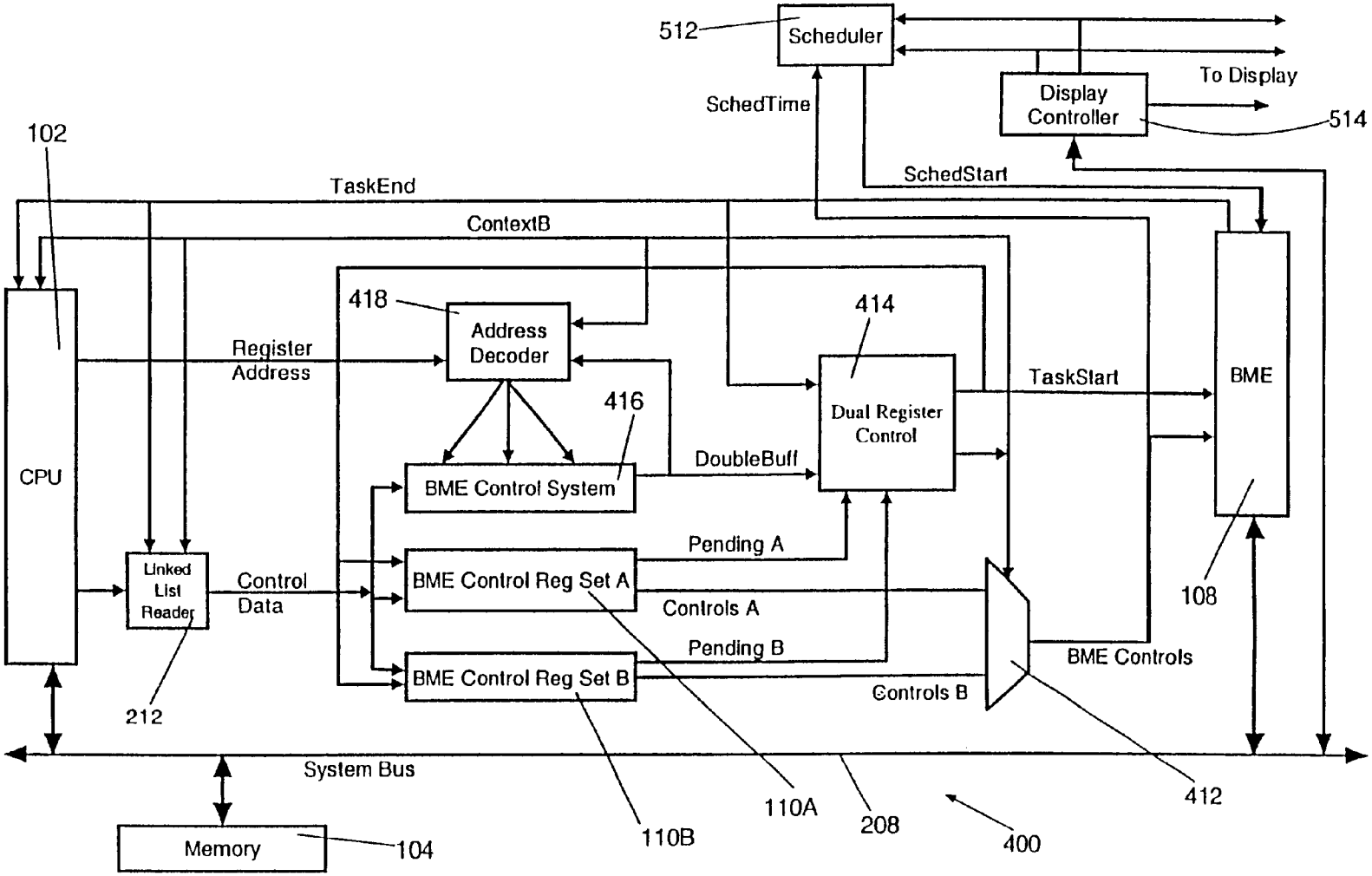
FIG. 5*d* is a block diagram of a modification to the system of FIG. 4*a* using the system of FIG. 5*a*.

It will be appreciated by those skilled in the art that it may be entirely possible to use the above described scheduler with the linked list reader (FIG. 5*b*), dual registers (FIG. 5*c*), and the combination of the linked list reader and dual registers (FIG. 5*d*) as described above. With the linked list reader, the signal TASKIMMEDIATE and the signal SCHEDTIME generated by the control the control registers 110 to use data from a linked list payload. The embodiment having dual registers, each registers 110*a* and 110*b* may have independent signal TASKIMMEDIATE and SCHEDTIME signals. It will be appreciated that the above described embodiments provide a number of technical advantages to a data processing system having a typical BME and mode of operation thereof.

While the invention has been particularly shown and described with reference to the preferred embodiments thereof, it will be understood by those skilled in the art that various changes in form and details may be made without departing from the spirit and scope of the invention.

What is claimed is:

1. A data processing system comprising:

a block move engine (i) for processing data and (ii) connected to a system bus;

a memory (i) configured to store data in the form of a linked list comprising a plurality of items of control data and (ii) connected to said system bus;

a register associated with said block move engine and configured to control said block move engine in response to said control data; and a reader configured to (i) read said control data received over said system bus from said memory and (ii) apply said control data to said register.

2. The data processing system according to claim 1, wherein each of said items of said linked list comprises:

a header; and a payload portion including said control data.

3. The data processing system according to claim 1, wherein:

said register comprises a plurality of control registers; and each of said items of said linked list comprises data configured to identify the control registers to be updated with control data from said item.

4. The data processing system according to claim 3, wherein:

said data comprises a header containing a plurality of bits each configured to be representative of a respective one of said control registers; and said reader is further configured to update each of said control registers in dependence on the logic state of an associated bit of said header.

5. The data processing system according to claim 3, wherein each of said items of said linked list includes a second control data.

6. The data processing system according to claim 1, further comprising:

a first and a second register associated with said block move engine and configured to control said block move engine in response to said control data;

a switch configured to selectively connect each of said first and second registers to said block move engine to apply control data; and a control circuit configured to control said switch and enable said system to operate in a doubled buffered mode, when in a first state and a context switching mode, when in a second state.

7. The data processing system according to claim 6, further comprising:

a mode control circuit configured to control a write enable status of each said first and second registers in response to said first and second states.

8. The data processing system according to claim 7, wherein said mode control circuit comprises:

an address decoder configured to monitor addresses indicating which control data is to be written to and control the write enable status of each said first and second registers in response to said addresses.

9. The data processing system according to claim 8, wherein said address decoder is further configured to map each of said first and second registers to (i) a same address in said memory when said system is operating in said double buffered mode and (ii) different addresses in said memory when said system is operating in said context switching mode.

10. The data processing system according to claim 1, further comprising:

a scheduler configured to (i) receive a schedule time and a count time and (ii) trigger said block move engine to begin processing data in accordance with said control data, wherein said count time is generated in response to a horizontal sync signal and a vertical sync signal.

11. The data processing system according to claim 10, wherein said scheduler comprises:

a display counter configured to receive said horizontal and vertical sync signals and generate said count time; and a comparator configured to compare said schedule time and said count time and generate a schedule start signal.

12. The data processing system according to claim 11, wherein:

said control data includes a task immediate signal switchable between active and inactive states; and said block move engine is further operable to begin processing of data in response to said schedule start signal.

13. The data processing system according to claim 1, further comprising:

a first register and a second register associated with said block move engine configured to (i) control said block move engine in response to said control data and (ii) generate a schedule time indicative of a scheduled time at which the block move engine is to begin processing said data;

a scheduler configured to receive said schedule time and generate a count time in response to a horizontal sync signal and a vertical sync signal;

a switch configured to selectively connect each of said first and second registers to said block move engine to apply control data; and a control circuit configured to control said switch and to enable said system to operate in (i) a doubled buffered mode when in a first state and (ii) a context switching mode when in a second state, wherein said scheduler is configured to compare said schedule time and said count time to trigger said block move engine to begin processing data in accordance with said control data.

14. A method of controlling an operation of a block move engine in a data processing system having a memory, comprising the steps of:

(A) generating and storing control data for controlling the operation of said block move engine, said control data being in the form of a linked list comprising a plurality of items of control data;

(B) reading the data from a first item in said linked list over a system bus;

(C) applying said data to said block move engine to control an operation of said block move engine connected to said system bus; and (D) repeating steps (B) and (C) for each subsequent item in said linked list.

15. The method of claim 14, wherein step (C) further comprises:

updating control registers with control data from said item.

16. The method of claim 15, wherein step (C) further comprises the sub steps of:

representing said control registers with a plurality of bits; and updating each of said control register in response to the logic state of an associated bit of a header.

17. The method according to claim 14, further comprising:

receiving control data for controlling said block move engine with a fist register and a second register;

generating control data for writing to one of said first and second registers;

indicating that said first and second registers comprise new control data for controlling a new task of the block move engine;

setting the operation of the system in a context switching mode when in a first state and a double buffered mode when in a second state; and selectively connecting each of said first and second registers to said block move engine in response to a mode signal.

18. The method according to claim 15, wherein:

step (A) further comprises generating a schedule time representative of a scheduled time at which the block move engine is to begin processing said graphics data;

step (A) further comprises generating a horizontal sync signal and a vertical sync signal;

step (A) further comprises generating a count time in dependence on said horizontal and vertical sync signals; and step (C) further comprises comparing said schedule time and said count time to trigger said block move engine to begin processing said graphics data in accordance with said control data.

19. The method of controlling an operation of a block move engine in a data processing system for processing moving graphics data for display on a display screen, the method comprising:

receiving control data over a system bus for controlling said block move engine with first and second registers;

setting the mode of operation of the system in a context switching mode when in a first state and a double buffered mode when in a second state;

selectively connecting each of said first and second registers to said block move engine in response to said first and second states;

generating control data;

writing said control data to said first and second registers;

indicating that said first and second registers comprise new control data for controlling a new task of the block move engine;

generating a schedule time representative of the scheduled time at which the block move engine is to begin processing said graphics data;

generating horizontal and vertical sync signals;

generating a count time in response to said horizontal and vertical sync signals;

comparing said schedule time and said count time; and triggering said block move engine to begin processing said graphics data in accordance with said control data in dependence on said comparison.

* * * * *